US006209642B1

(12) United States Patent
Streetman

(10) Patent No.: US 6,209,642 B1
(45) **Date of Patent: *Apr. 3, 2001**

(54) APPARATUS AND METHOD FOR ENHANCING FLUID AND GAS RECOVERY IN A WELL

(76) Inventor: Foy Streetman, 401 Chickasha Ave., Chickasha, OK (US) 73023

( * ) Notice: Subject to any disclaimer, the term of this patent is extended or adjusted under 35 U.S.C. 154(b) by 0 days.

This patent is subject to a terminal disclaimer.

(21) Appl. No.: 09/196,502

(22) Filed: Nov. 19, 1998

Related U.S. Application Data

(63) Continuation-in-part of application No. 09/057,039, filed on Apr. 8, 1998.

(51) Int. Cl.[7] ..... E21B 43/34
(52) U.S. Cl. ..... 166/267
(58) Field of Search ..... 166/267, 265, 166/53

(56) References Cited

U.S. PATENT DOCUMENTS

| | | | | |
|---|---|---|---|---|
| 4,352,376 | * | 10/1982 | Norwood | 137/624.15 |
| 4,434,849 | * | 3/1984 | Allen | 166/252 |
| 4,685,522 | * | 8/1987 | Dixon et al. | 166/372 |
| 5,111,883 | * | 5/1992 | Savery | 166/269 |
| 5,132,904 | * | 7/1992 | Lamp | 364/422 |
| 5,823,262 | * | 8/1999 | Dutton | 166/250.15 |
| 5,937,946 | * | 8/1999 | Streetman | 166/267 |

* cited by examiner

*Primary Examiner*—William Neuder
*Assistant Examiner*—Zakiya Walker
(74) *Attorney, Agent, or Firm*—R. William Graham

(57) ABSTRACT

An apparatus for enhancing fluid and gas flow recovery in a well includes an upstream flow line communicably connected at one end to the well in a manner to receive fluid and gas therefrom, a fluid and gas separator communicably connected to another end of the upstream flow line in a manner to receive fluid and gas flow therefrom, a downstream sales flow line communicably connected to the fluid and gas separator in a manner to receive gas flow therefrom, a control valve operably disposed in the upstream flow line, a local controller device operably controllably connected to the control valve in a manner to permit regulated flow through the upstream flow line at a predetermined amount and having a communications device associated therewith, and a remote controller device having a communications device therewith, wherein the local controller device and remote controller device communicate with one another to enable remote control of the control valve. Also, a pressure differential control is operably disposed in the downstream sales line for comparatively sensing pressure differential in the downstream sales line about a restricted region in the downstream sales flow line which is also operably controllably connected to the control valve in a manner to permit regulated flow through the upstream flow line at a predetermined amount in response to the sensed pressure differential. A method is also provided.

6 Claims, 4 Drawing Sheets

APPARATUS AND METHOD FOR ENHANCING FLUID AND GAS RECOVERY IN A WELL

This is a continuation-in-part of U.S. patent application Ser. No. 09/057,039 filed Apr. 8, 1998.

BACKGROUND OF THE INVENTION

1. Field of the Invention

This invention relates to enhanced recovery from a well. More specifically, this invention relates to an improved apparatus that enhances recovery in oil and gas wells by employing regulated flow devices and techniques and optionally in combination the addition of fluid enhancing additives.

2. Related Art

As was discussed in applicant's application U.S. Ser. No. 09/057,039, each well has its own predetermined optimal recovery conditions which are determined by the natural geological formation of the well. When a successful well is drilled, there is commonly enough gas-volume to fluid-ratio and bottom hole pressure to create a natural flow from the well. This ability to flow at a certain velocity to insure fluids are lifted is termed "critical flow rate." The ability to substantially maintain or simulate natural flow conditions is critical in optimizing recovery.

Under the natural flow pressure, fluid flow is created by virtue of the liquid being broken up into small units by gas existing therein and is carried to the surface due to a fluid "lightening" effect under gaseous expansion to achieve critical flow rate. The combined gas and liquid are transferred via an upstream flow line to a fluid/gas separator which is designed to remove the liquid into storage tanks and remove the gas to a downstream sales flow line which commonly connects with a utility service provider at what is more commonly referred to as the pipeline.

Unfortunately, in new tight gas sand wells or older wells having reduced reserve volumes, and pressure in the well depletes during the flow cycle and negatively impacts the optimal recovery conditions and flow needed to achieve critical flow rates. As a result, typically only part of the oil and gas contained in the underground formation by a primary recovery method which uses the natural flow force present in the reservoir is possible. A variety of enhanced recovery techniques such as artificial lift systems, so-called secondary or tertiary recovery methods, have been employed to increase the recovery of oil and gas from subterranean reservoirs.

A common artificial lift, secondary recovery method includes a combination of shutting in the well for a period of time to allow for pressure build up and allowing a plunger to drop to the bottom of the well and then opening the well causing the plunger to drive the fluid to the surface. Another such enhanced recovery technique is to use a pump truck to pump additives into the oil well-bore. These additives can, for example, reduce scale, paraffine and the viscosity of the oil and increase production of oil recovery.

A problem with these prior techniques is the lack of proper control in order to carry out those techniques during initiation and slow down of flow within a well. Also, waste can occur downstream in that metering devices of service providers to which the downstream sales flow line connects do not properly meter or record spikes (temporary large amounts of gas over that recordable by the meter) which occur during the other recovery methods. In this regard, care must be taken to maintain optimal recovery conditions in carrying out other recovery methods.

Applicant's prior said application is directed at solving a significant part of the aforementioned problems by providing an apparatus which controls the flow within the downstream sales line. There remains a need to improve upon enhancing oil and gas recovery techniques such as those of the present invention.

BRIEF SUMMARY OF THE INVENTION

It is an object to control well production via a remote control device.

It is an object of the present invention to enhance fluid and gas flow in a well.

It is another object to improve the apparatus for enhancing fluid and gas flow in a well.

It is still another object to artificially induce optimal recovery conditions in a well, while maintaining its flow at a measurable rate.

Yet another object is to establish flow patterns which improve the promotion of fluid break up into droplets and thus prevent fluid from falling back into the well during well shut-in periods.

It is another object to create another marketing vehicle for production.

Accordingly, the present invention is directed to an apparatus for enhancing fluid and gas flow in a recovery includes an upstream flow line communicably connected at one end to the well in a manner to receive fluid and gas therefrom. A fluid and gas separator communicably connects to another end of the upstream flow line in a manner to receive fluid and gas flow therefrom. A downstream sales flow line communicably connects to the fluid and gas separator in a manner to receive gas flow therefrom. A control valve is operably disposed in the upstream flow line.

A local controller device operably controllably connects to the control valve in a manner to permit regulated flow through the upstream flow line at a predetermined amount and has a communications device associated therewith. A remote controller device having a communications device therewith is also provided, wherein the local controller device and remote controller device communicate with one another to enable remote control of the control valve.

A pressure differential control is operably disposed in the downstream sales line for comparatively sensing pressure differential in the downstream sales line about a restricted region in the downstream sales flow line which is operably controllably connected to the control valve in a manner to permit regulated flow through the upstream flow line at a predetermined amount in response to the sensed pressure differential.

Another aspect of the invention includes the introduction of additives into the well-bore to increase recovery, wherein the additives are activated and controlled by flow patterns established therein. A benefit realized is the ability to size the injection tubing whereby it reduces the capacity in the flowing through the tubing such that a siphoning action is created.

A method of the present invention includes the steps of controllably delivering fluid and gas from a well in a single inlet flow path to a separator, separating the fluid from the gas into two separate outlet flow paths from the separator, and remotely controllably regulating flow of the fluid and the gas in the inlet path. The method also includes comparatively sensing pressure of gas about a restricted region of the outflow path, and controllably regulating flow rate of the fluid and the gas in the inlet path in response to the sensed pressures and in accordance with a predetermined flow rate. Additionally, the method may include the adding of a flow enhancing additive to the well.

Other objects and advantages will be readily apparent to those skilled in the art upon viewing the drawings and reading the detailed description hereafter.

DETAILED DESCRIPTION OF THE INVENTION

Figures 1, 1B:
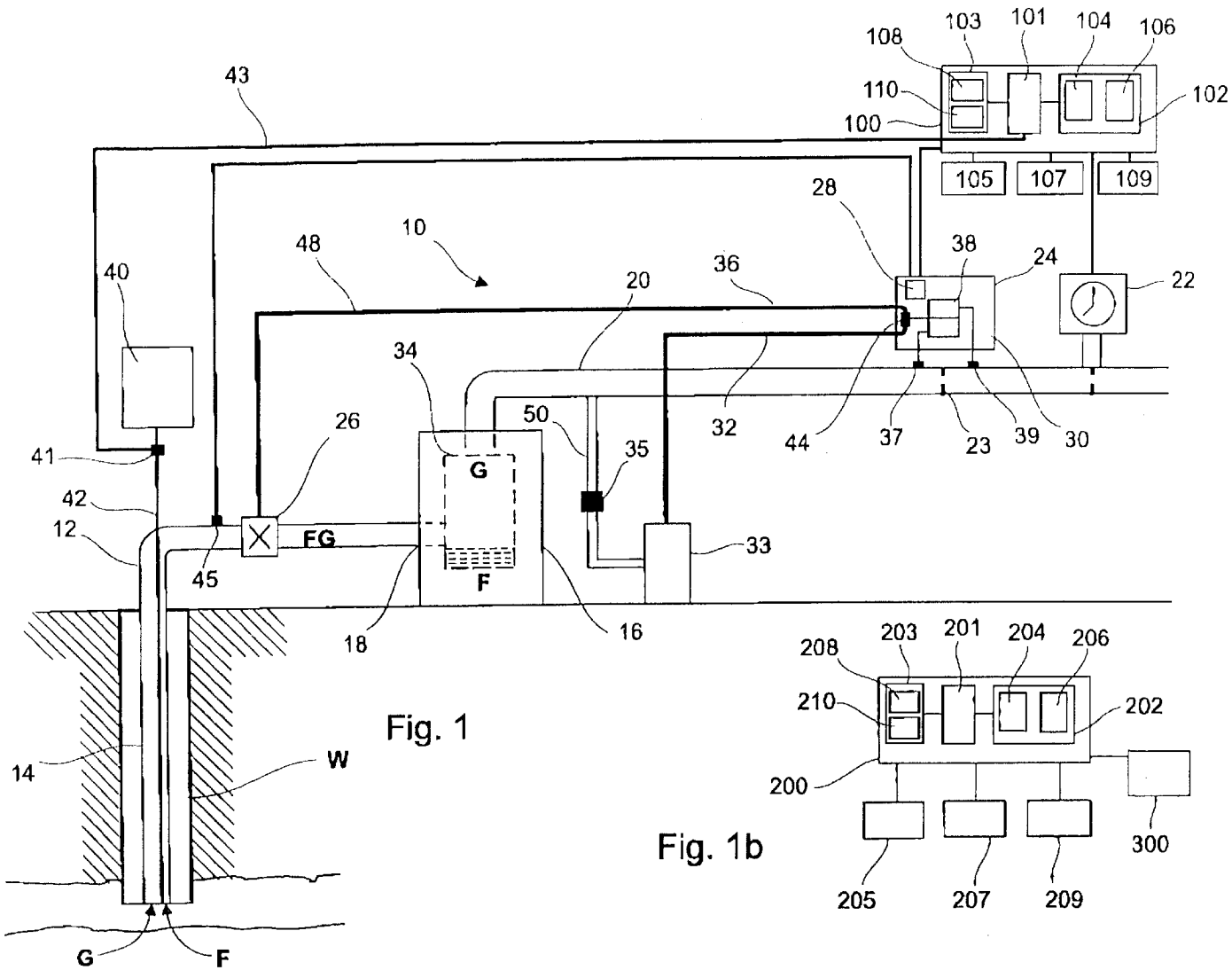
FIG. 1 is a schematic diagram of the present invention.
FIG. 1*b* is a schematic diagram of a remote controller device of the present invention.

Referring to the drawings, the apparatus for enhancing fluid and gas recovery in a well W of the present invention is generally referred to by the numeral 10. The apparatus 10 includes an upstream flow line 12 communicably connected at one end 14 to the well W in a manner to receive fluid F and gas G therefrom. A fluid and gas separator 16 communicably connects to another end 18 of the upstream flow line 12 in a manner to receive fluid F and gas G flow therefrom. A downstream sales flow line 20 communicably connects to the fluid and gas separator 16 in a manner to receive gas G flow therefrom.

A gas metering device 22 of a provider is operably disposed in the downstream sales flow line 20. A local well site based controller device 100 is operably disposed adjacent the well W and includes a communications device 102. The controller device 100 preferably is a CPU having a processor 101 with an associated memory 103, display 105, keyboard 107 and a suitable power source 109. The communications device 102 includes a transmitter 104 and receiver 106. The controller device 100 has communications software 108 operatively disposed in the memory 103 of the CPU and is operably associated with the receiver 106 and transmitter 104. The controller device 100 includes controller software 110 resident in the memory 103 thereof and is operably associated with the gas metering device 22 and communications software 108 in a manner to enable gas flow rate detection and generate a transmission signal of the same. It is contemplated that the gas metering device 22 may be either external or integral to the controller device 100. Additionally, the controller device 100 is operably connected to a control valve 26 as later described and the controller software 110 is further characterized to enable opening and closing the control valve 26.

A remote based controller device 200 is operably disposed at a remote site R and includes a communications device 202. The controller device 200 preferably is a CPU having a processor 201 with an associated memory 203, display 205 and keyboard 207 and a suitable power source 209. The communications device 202 includes a transmitter 204 and receiver 206. The controller device 200 has communications software 208 operatively disposed in the memory 203 of the CPU and is operably associated with the receiver 204 and transmitter 206. The communications software 208 is complementary coded to the communications software 108 to enable communication between the devices 100 and 200. It is contemplated that communication may take place via radio, satellite, cellular tower or convention land line, wherein signals are transmitted between the devices 100 and 200.

Via the connections recited above, the controller device 100 transmits flow rates in the downstream sales flow line 20 to the controller device 200. The controller device 200 includes flow analysis and control software 210 resident in the memory 203 of the CPU which upon receiving the flow rate signals, manipulates the flow rate signals to produce optimum well shut in and flow periods. The flow analysis and control software 210 monitors flow rate signals over a predetermined period wherein a peak flow rate is observed after the well W has been shut in for a period of time, e.g., several hours. The controller device 200 transmits a signal to the controller device 100 causing the control valve 26 to close and shut in the well W for a predetermined period. After the predetermined period of time, the controller device 200 transmits a signal to the controller device 100 to cause the control valve 26 to open. Flow rates are sensed by the controller device 100 and transmitted to the controller device 200. Peak flow rate and minimum flow rate are observed by the flow analysis and control software 210. When the flow rate drops below a predetermined level in the well W, the flow analysis and control software 210 causes the controller device 200 to transmit a signal to the controller device 100 to shut in the well W and the pressure is allowed to build in the well W. This process is repeated and the flow analysis and control software 210 learns the optimum shut in time in order to achieve maximum peak flow rates. Also, the flow analysis and control software 210 learns the diminished flow rates of the well W.

Figure 2:
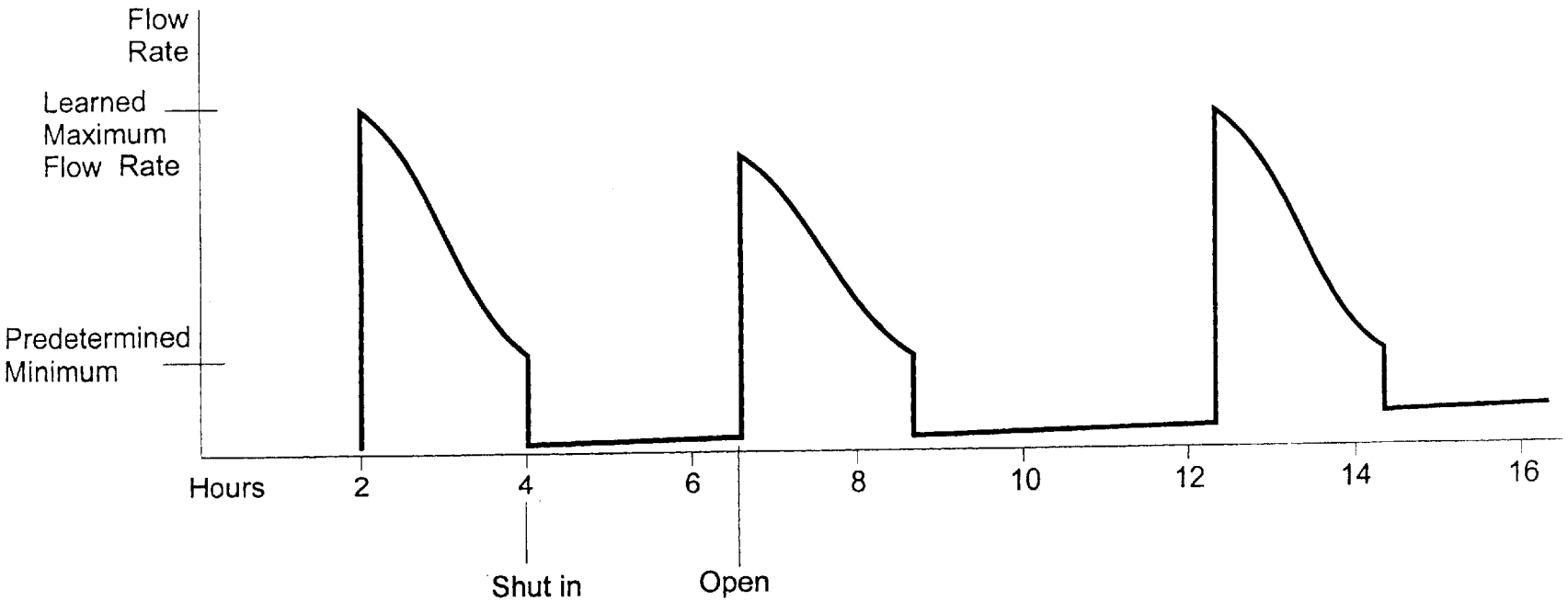
FIG. 2 is a graphical representation of the flow patterns of a well for a given period under a learning phase employing the present invention.

This learning process is depicted in FIG. 2 wherein the well W is shut in using different time periods until the maximum flow rate is achieved. Once learned, the flow analysis and control software 210 causes the controller device 200 to transmit a signal to the controller device 100 to fix the shut-in and open times in accordance with the learned maximum rate and minimum flow rate. The controller device 100 thereafter periodically transmits flow rate signals to the controller device 200 for purposes of determining the production of the well W and further attenuation using the flow analysis and control software 210.

Figure 1A:
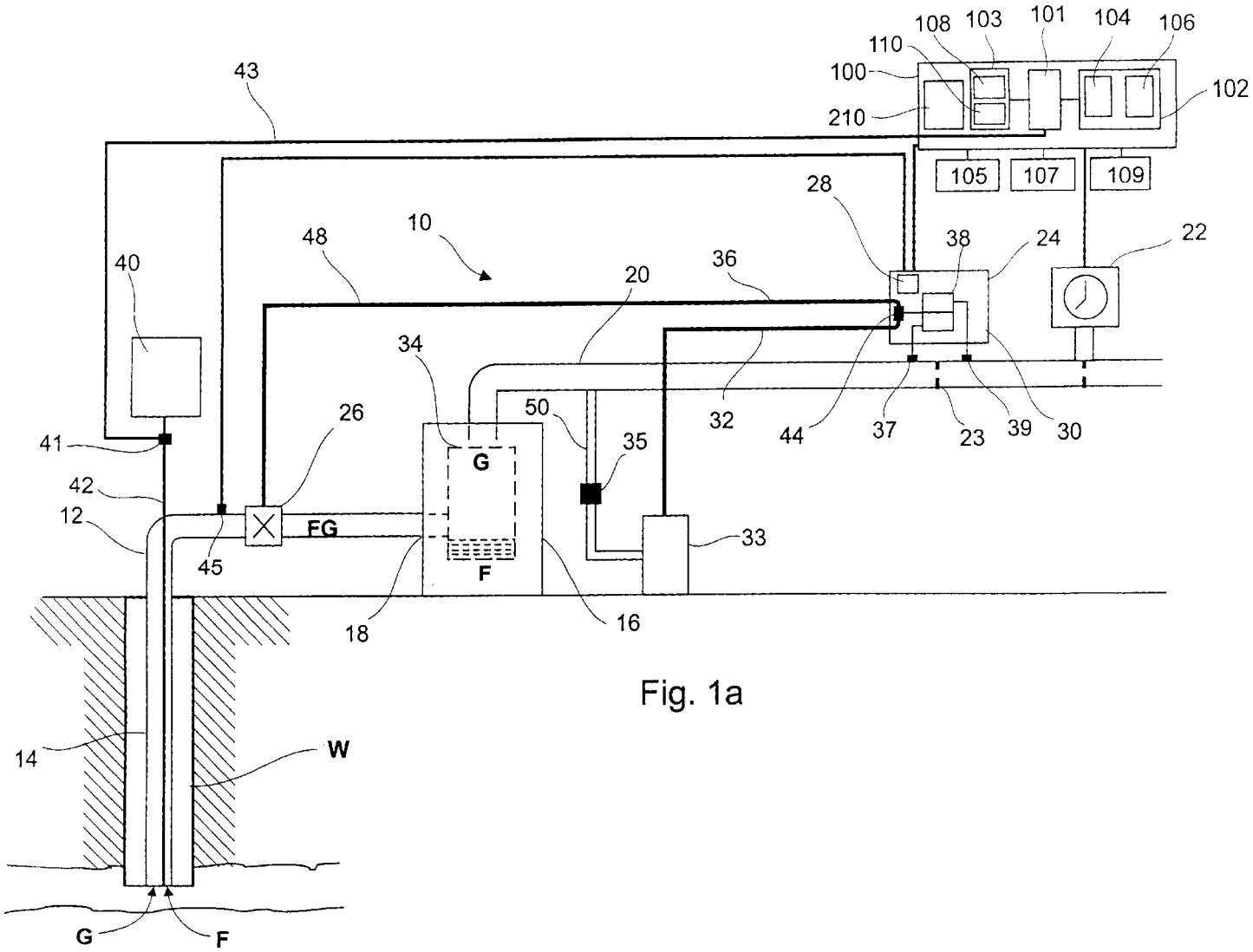
FIG. 1*a* is a schematic diagram of another embodiment of the present invention.

While the flow analysis and control software 210 is depicted on the remote controller device 200, it is contemplated that the same can be integrated into the controller device 100 as seen in FIG. 1*a*. However, the remote site controller device is employed as it will serve as a hub which will control a large number of wells from a common site.

In this regard, it is another aspect of the invention that this well W production information be transmitted by the controller device 200 to an Internet web site 300 wherein the production information is posted for purposes of sale. Prior hereto, marginal well owners were forced to deal with third party marketers which bought the well production at a low cost, pooled a group of wells and sold the production to the consumer. By providing the present invention, this obviates the need for third party marketers. Now, owners of one or a few marginal wells can sell their production on an equal footing with large producers and gain comparable market rate as large producers while providing the consumer a potentially lower cost of goods.

The invention also includes a restricted region or orifice 23 which is formed in the downstream sales flow line 20. A pressure differential control (PDC) 24 is operably associated with the downstream sales flow line 20 between the gas metering device 22 and the fluid and gas separator 16 and is shown in one aspect for sensing pressure differential in the downstream sales flow line 20 about the orifice 23. The control valve 26 is operably disposed in the upstream flow line 12 and is operably controllably connected to the PDC 24 in a manner to permit regulated flow through the upstream flow line 12 at a predetermined amount in response to the sensed pressure differential. Optionally, the PDC 24 may include a timer device 28 which can also be used alone or in combination to control the control valve 26 to restrict and open at a predetermined time in accordance with the predetermined flow characteristics of the well W, i.e. its natural flow rate. Here, the controller device 100 is preferably operably connected to the PDC 24 and employs the use of a controlled transfer valve 44 hereinafter described to open and close the control valve 26. It is also recognized that the controller device 100 may be directly connected to control valve 26 employing either pneumatic or electrical means for operation thereof. Optionally, the PDC 24 may be connected to another pressure sensor 45 on the upstream flow line 12 which may be used in establishing the predetermined flow characteristics of the well W.

The PDC 24 is equipped with means 30 for sensing when the pressure differential. The sensing means 30 can be mechanically or electrically based. In this regard, the sensing means 30 is operably connected to the controlled transfer valve 44 which is connected to one end 36 of a line 48 which sends a supply gas as a signal to the inlet control valve 26 for operation thereof. This supply gas emanates from a line 32 which is operably connected to a scrubber 33. The scrubber 33 is in turn operatively connected to a line 50 having a regulator 35 therein. The line 50 is operably connected to the downstream flow line 20 to receive gas therefrom. The sensing means 30, includes a pressure transducer 38 which is operably connected to the downstream sales flow line 20 having two pressure sensors 37 and 39 operably employed on the downstream flow line 20 about the orifice 23 in order to sense the amount of pressure differential about the orifice 23. The components aid to regulate the supply of gas in the downstream flow line 20.

Figure 3:
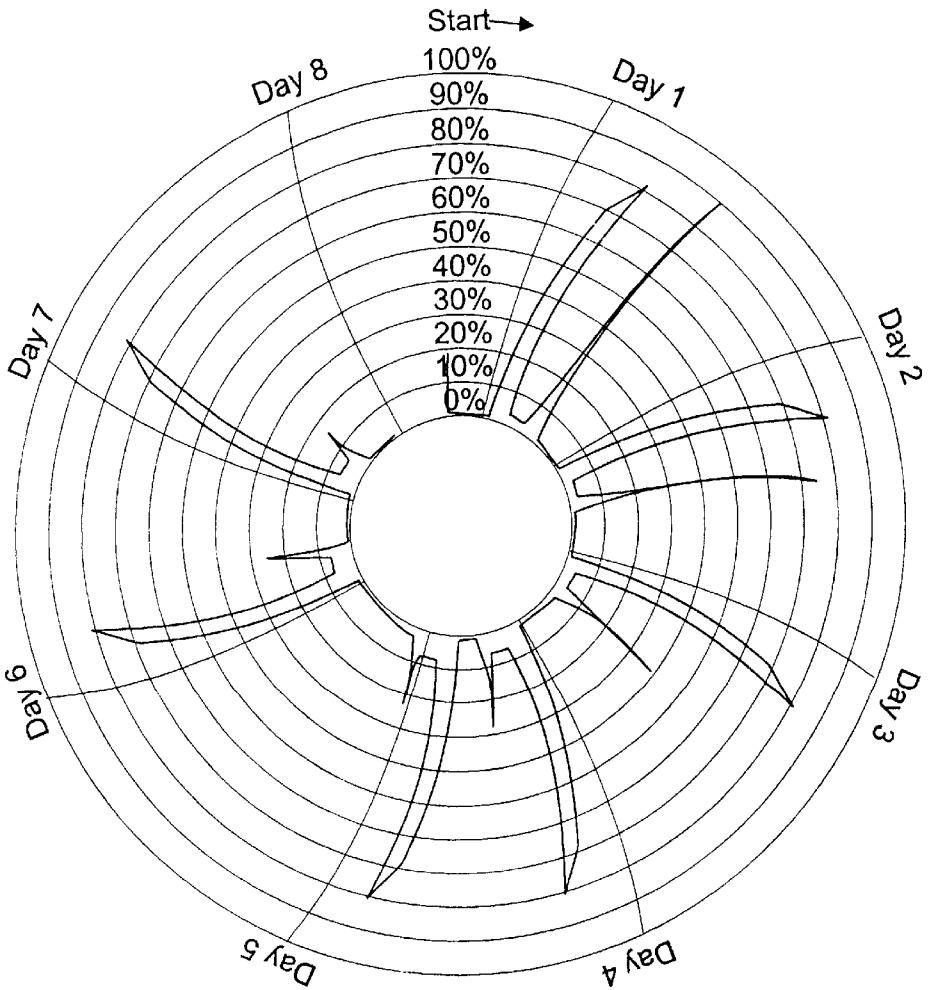
FIG. 3 is a graphical representation of the flow patterns of a well for a given period.

As the PDC 24 senses pressure differentials above or below a predetermined threshold range, the PDC 24 sends a supply signal to the control valve 26 via a transfer valve 44 causing it to restrict or open accordingly. For example, when fluids F and gas G are flowing in the upstream flow line 12, and the flow of gas G decreases, then flow decreases in the downstream sales flow line 20. The PDC 24 senses the decrease in gas G flow and further opens the control valve 26. This enables fluids F and gas G to enter the separator 16 faster and reduces back-pressure in the well W which would normally cause fluids F to fall back down the well W. Without this immediate and preferably automatic opening of the control valve 26 which relieves this condition, the fluids F would begin falling back into the well W before reaching the surface. Conversely, as flow in the upstream flow line 12 increases, flow in the downstream sales flow line 20 increases which initiates the PDC 24 to actuate the control valve 24 to restrict, thus keeping the flow conditions at an optimum to lift fluids F and for a longer period and also prevent over-ranging the meter 22. This volume flow control keeps gas G at a rate which is not too fast or slow, but sufficient to provide lift of the fluid F. Optimal flow can be achieved and is reflected in FIG. 3.

It is important to note that if the proper flow rates are not maintained, the fluids tend to lay against the tubing wall and won't come to the surface. As previously stated, the natural flow rate can be determined as described above as a function of a particular well's original natural geological characteristics and this flow rate is what is ideally attempted to be maintained by the PDC 24.

Since the gas G expands as it moves toward the surface of the well W, the fluid F is necessarily drawn to the top with the gas G and the rate is necessarily a function of the gas G maintained in the fluid F. The separator 16 affects the optimal recovery by virtue of separating the gas G from the fluid F. Accordingly, an aim of the invention is to maintain an acceptable flow rate which optimally promotes fluid F and gas G flow in a manner which avoids the deleterious effects of spiking caused by restricting flow of the well W. The PDC 24 thus is employed in the present invention to keep the flow rate in the predefined measurable range within the down stream sales flow line 20.

Additionally, chemical and biochemical additives 40 can be added to further enhance recovery production. Such additives 40 can be liquid or solid type, such as microorganisms, foaming agents or viscosity modifiers which are delivered to the bottom of the well W by a tubing 42, for example. This injection string of tubing 42 can be sized so it will displace part of the flow capacity which permits the siphoning action or critical flow rates to be created with less force in the well formation than would be required in a more productive well. An electrically operated control valve 41 is disposed within the tubing 42 and is operably connected to the controller device 100 via an electrical line 43. The controller device 200 can also control the operation of adding additives 40 from the remote site via flow analysis and control software 210.

The method of the present invention includes the steps of controllably delivering fluid and gas from a well in a single inlet flow path to a separator, separating the fluid from the gas into two separate outlet flow paths from the separator, sensing flow rate in the gas outlet flow path, employing a controller device to determine peak flow rate, diminished flow rate and optimal shut-in period and open period of the well. The method also includes comparatively sensing pressure of gas in the outflow path about a restricted region in a downstream sales flow line, and controllably regulating flow rate of the fluid and the gas in the inlet path in response to the sensed pressures. Additionally, pressure is sensed by sensor 45 in the upstream flow line or timed controlled of the flow restriction can be employed to control the proper pressure for obtaining optimal flow conditions. Additionally, the method further includes the adding of a flow enhancing additive to the well.

By so providing the present invention, there is realized enhanced recovery of fluid and gas. The present invention provides for an enhanced method and apparatus for controlling the metered gas which is recovered. The present invention provides for a new mechanism by which marginal well gas can be marketed and sold with greatest efficiency.

The above described embodiment is set forth by way of example and is not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. An apparatus for enhancing fluid and gas flow in a well; which includes:

an upstream flow line communicably connected at one end to the well in a manner to receive fluid and gas therefrom;

a fluid and gas separator communicably connected to another end of said upstream flow line in a manner to receive fluid and gas flow therefrom;

a downstream sales flow line communicably connected to said fluid and gas separator in a manner to receive gas flow therefrom;

a control valve operably disposed in the upstream flow line;

a first controller device operably controllably connected to the control valve in a manner to permit regulated flow through the upstream flow line at a predetermined amount and having a communications device associated therewith;

a second controller device having a communications device associated therewith, wherein the first controller device and the second controller device communicate with one another to enable control of the control valve;

means for sensing flow rate in said downstream sales flow line;

means operably associated with said sensing means for determining peak flow rate and minimum flow rate and generating an optimum shut-in period and flow period for the well; and means operably associated with said determining means for controlling said control valve in a manner to permit regulated flow through said upstream flow line in accordance with said optimum shut-in period and flow period.

2. The apparatus of claim 1, wherein said first controller device is a local controller device operably controllably connected to the control valve and said second controller device is a remote controller device, wherein the local controller device and the remote controller device communicate with one another to enable remote control of the control valve.

3. The apparatus of claim 1, which further includes a pressure differential control operably disposed in the downstream sales line for comparatively sensing pressure differential in the downstream sales line about a restricted region in the downstream sales flow line and which is operably controllably connected to said control valve in a manner to regulate flow through said upstream flow line at a predetermined amount in response to the sensed pressure differential.

4. The apparatus of claim 3, wherein said pressure differential control is operatively connected to said controlling means.

5. The apparatus of claim 1, which further includes means operably connected to said controlling means for introducing fluid flow enhancing additives into the well.

6. The apparatus of claim 1, wherein said controlling means is a computer- based device.

* * * * *